US005884829A

United States Patent [19]

Wingert

[11] Patent Number: 5,884,829

[45] Date of Patent: Mar. 23, 1999

[54] DUAL PURPOSE STAPLE GUN TACKER

[75] Inventor: Rudolf Wingert, West Milford, N.J.

[73] Assignee: Arrow Fastener Co., Inc., N.J.

[21] Appl. No.: 736,331

[22] Filed: Oct. 23, 1996

[51] Int. Cl.[6] ..... B25C 1/04

[52] U.S. Cl. ..... 227/151; 227/132; 227/142; 227/109

[58] Field of Search ..... 227/109, 132, 227/134, 142, 151, 123, 150

[56] References Cited

U.S. PATENT DOCUMENTS

| | | | |
|---|---|---|---|
| 2,947,003 | 8/1960 | Ericsson | 227/123 |
| 4,552,296 | 11/1985 | Sheng | 227/109 |
| 4,693,407 | 9/1987 | Buck et al. | 227/109 |
| 5,219,110 | 6/1993 | Mukoyama | 227/142 |
| 5,263,626 | 11/1993 | Howard et al. | 227/142 |
| 5,263,842 | 11/1993 | Fealey | 227/142 |
| 5,484,094 | 1/1996 | Gupta | 227/142 |
| 5,626,274 | 5/1997 | Shkolnikov et al. | 227/109 |

*Primary Examiner*—Scott A. Smith
*Attorney, Agent, or Firm*—Fitzpatrick, Cella, Harper & Scinto

[57] ABSTRACT

A staple gun tacker for driving staples of various leg lengths is disclosed in which the staple gun housing has a front staple gun driving end and a base. The base has a staple discharge opening formed therein through which staples to be driven by the staple gun are discharged into a workpiece. A staple spacer guide is slidably mounted on the staple driving end of the housing and includes a free end which extends beyond the staple discharge opening and the base of the staple gun. Cooperating means are provided on the spacer guide and the housing to enable the spacer guide to be retracted along the housing relative to the base, thereby to control the position of the staple discharge opening relative to the workpiece into which a staple is to be driven. By controlling the position of the staple driving end of the staple gun relative to the workpiece, the depth to which a particular staple is driven in the workpiece can be controlled to avoid damage to the item being stapled to the workpiece.

10 Claims, 4 Drawing Sheets

DUAL PURPOSE STAPLE GUN TACKER

CROSS REFERENCE TO RELATED APPLICATIONS (Not Applicable)

STATEMENT REGARDING FEDERALLY RESPONSIVE RESEARCH OR DEVELOPMENT (Not Applicable)

BACKGROUND OF THE INVENTION

The present invention relates to staple gun tackers and more in particular to staple gun tackers which are adapted to drive staples of multiple lengths and shapes to varying controlled depths.

Heavy duty staple gun tackers are well known hand tools which are adapted to drive staples of varying lengths into a workpiece in order to tack something to the workpiece or work surface. Such staple gun tackers are very popular in use, particularly those sold by the Arrow Fastener Company, Inc. under the trademarks T-50® and T-25®. Such staple gun tackers are designed to drive staples in a range of leg lengths.

The Arrow Fastener Company has developed specific staple guns which are adapted to drive staples having a round crown shape, which staples are used for stapling telephone wires, electrical cables, and the like, to a workpiece. Such staple gun tackers, while entirely satisfactory in use, have not had the ability to control the depth to which the staples are driven. Thus, whether the wire to be attached to a workpiece was a small diameter wire or a larger diameter wire, the staple was driven to essentially the same depth. As a result, when a large diameter wire was used, it was possible that the wire would be damaged by the bight portion of the staple when the staple was driven. In order to avoid that possibility sometimes larger size staples than necessary were used to hold the wire to the workpiece.

BRIEF SUMMARY OF THE INVENTION

It is an object of the present invention to provide a staple gun tacker which is adapted to drive staples to a variety of different depths.

Another object of the present invention is to provide a staple gun tacker of relatively simple construction which can drive staples of various sizes and shapes to different depths.

Yet another object of the present invention is to provide a staple gun tacker of the character described which is relatively simple in construction and reliable in use.

A further object of the invention is to provide a staple gun which will drive staples having flat or round crowns.

In accordance with an aspect of the present invention, a staple gun tacker is provided which has an internal staple driving mechanism of conventional construction. The staple driving mechanism used in the invention can be any of the mechanisms used, for example, in the Arrow T-50®, T-25® and T-75™ staple gun tackers. The mechanism, per se, forms no part of the present invention.

The staple gun tacker of the invention includes a housing containing the driving mechanism. The housing has a front staple driving end and a base which includes a staple discharge opening. As will be apparent to those skilled in the art, staples contained in a magazine mounted in the base of the staple gun are discharged by a driving knife operated in the staple gun's front driving end when the handle of the staple gun is depressed.

The bottom edge of the front staple driving end of the housing is engaged against a workpiece when a conventional staple gun is operated. The staple in the staple gun will then be driven to a depth dependent upon the power of the staple driving mechanism in the housing and the length of the staple leg. The staple gun has no ability to control the depth to which the leg is driven.

In accordance with the present invention, a staple spacer guide is slidably mounted on the staple driving end of the housing adjacent the staple discharge opening in its base. The guide has a free end which extends beyond the staple discharge opening. Means are provided for selectively controlling the position of the free end of the spacer guide on the housing relative to the position of the staple discharge opening. The free end of the staple guide engages the workpiece and thus spaces the discharge opening away from the workpiece a selected distance depending upon its position. In this way, when the staple is driven, the depth to which its legs can penetrate the workpiece is controlled by the position of the guide relative to the discharge opening. The further the free end of the guide is from the discharge opening, the less the legs of the staple will penetrate.

The above and other objects, features and advantages of this invention will be apparent in the following detailed description of an illustrative embodiment thereof, which is to be read in connection with the accompanying drawings, wherein:

DETAILED DESCRIPTION OF THE INVENTION

Figure 1:
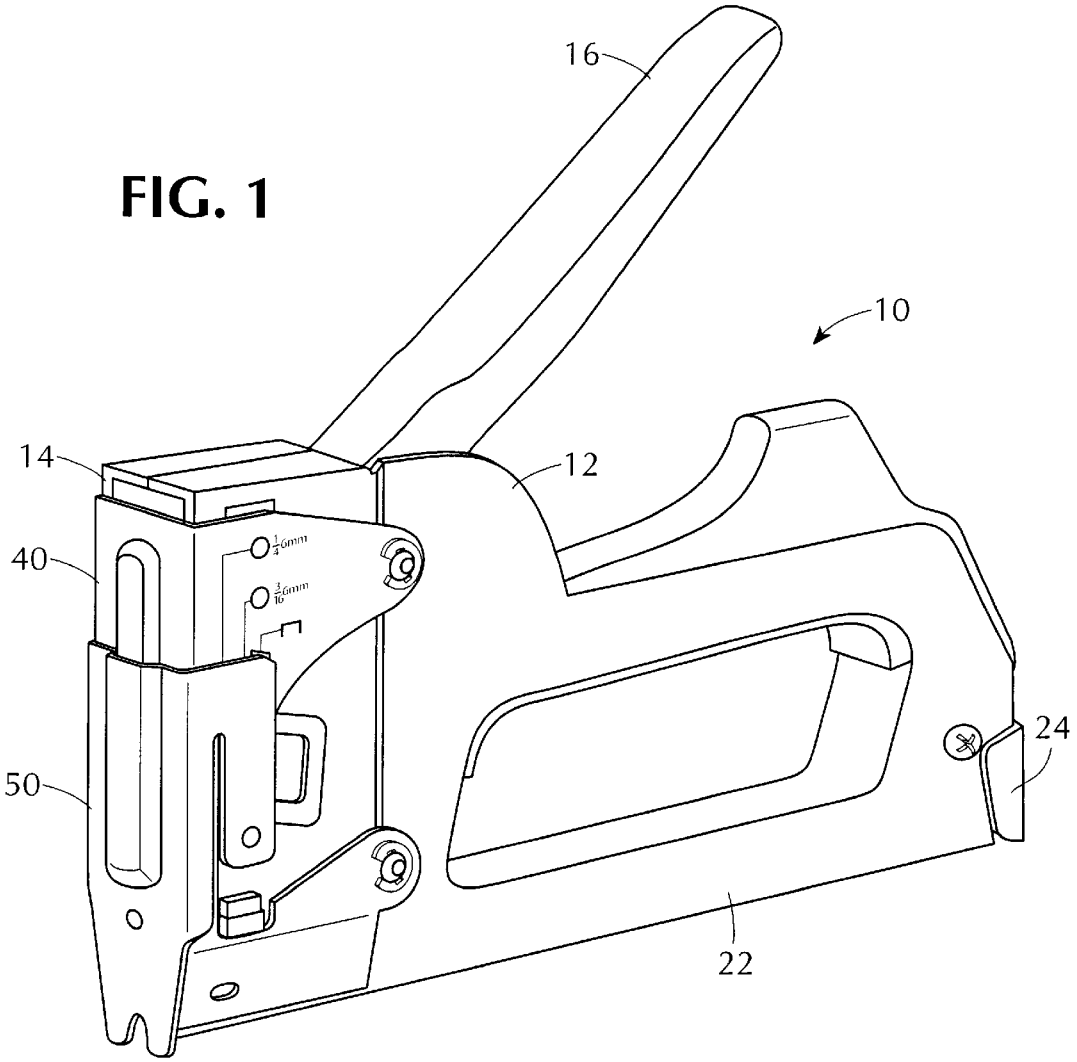
FIG. 1 is a perspective view of a staple gun tacker constructed in accordance with the present invention.

Referring now to the drawings in detail, and initially to FIG. 1, a staple gun tacker 10 constructed in accordance with the present invention is illustrated. Staple gun tacker 10 includes a housing 12 of generally conventional construction containing a drive mechanism (not shown) also of conventional construction such as is available in the Arrow T-50®, T-25™ and/or T-75™ staple gun tackers. Housing 12 includes a front driving end 14 and a handle 16 which, when squeezed in a conventional manner, operates the driving mechanism to power and fire a driving knife 18 (see FIGS. 5 and 6) which moves vertically in the front end 14 of housing 12 to engage a staple in the front end of a magazine in the base of the housing to drive it into the workpiece 20. The staples are contained in a conventional magazine (not shown) mounted in the conventional manner within the base 22 of the housing. The staples are supplied in a conventional manner in a strip of staples adhered together and held in place by a pusher arrangement 24, also of conventional construction.

Figure 4:
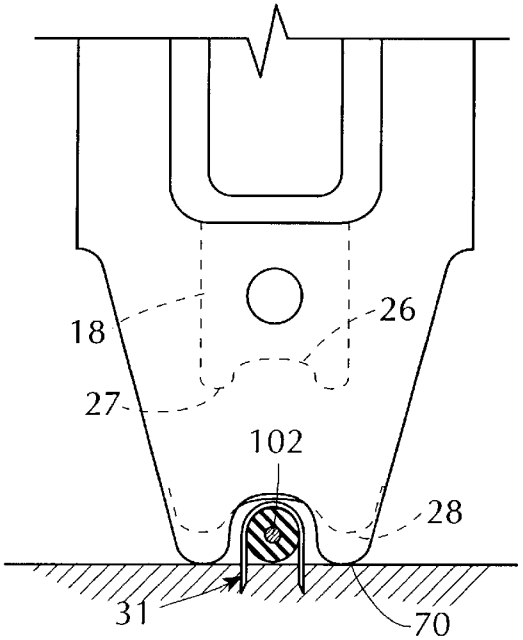
Figure 3:
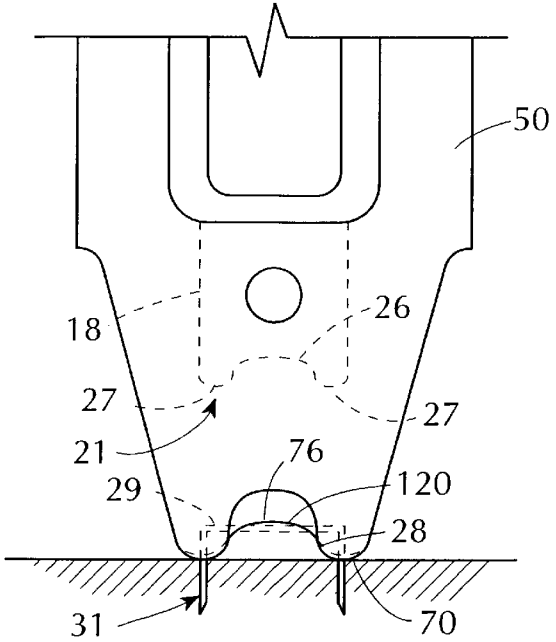

The free end 21 of knife 18 (shown in its raised position in dotted lines in FIGS. 3 and 4), may be shaped in a known manner to have a concave edge 26 between the flat segments 27 in order to drive staples having round crowns, such as for example the staples shown at 28 and 30 in FIGS. 3 and 4, respectively. The round shape 26 of the edge of the knife edge 21 engages the round crown of the staple so as to maintain the staple's round shape during the driving operation. However, Applicant has found that staple gun tackers with this rounded end for knife 18 are equally suitable for driving flat crowned staples. In that case the flat segments 27 of knife 21 engage the flat crown of the staple 31 above the staple legs to drive the staple into the workpiece, as seen in FIG. 3.

The front end 14 of staple gun tacker 10 includes a drive mechanism cover 40 of generally conventional construction such as heretofore been used by conventional staple gun tackers. The lower end 41 of cover 40, adjacent the point at which the staple is ejected from the staple gun, has a concave edge 76 formed in it to enable the front end or nose of the staple gun to straddle a wire to be secured to a workpiece.

Cover 40 also is shaped, particularly in the area 42 (illustrated in FIG. 2), in order to provide a plurality of stop surfaces 44 along an edge of the cover, for reasons described hereinafter.

A staple spacer guide 50 is slidably mounted on housing 12 over cover 40. Spacer 50 is shown in greater detail in FIG. 2. As seen therein, spacer 50 has a front face 52 and a pair of perpendicularly extending side walls 54, 56 which overly the sides of housing 12 and cover 40. Side walls 54, 56 are slotted at 58 in order to provide a pair of legs 60, 62, respectively.

Guide 50 is adapted to slide relative to cover 40, as described hereinafter, between two extreme limits to control the penetration of staples driven by the staple gun tacker. It includes a free end 70 and has an arcuate recess 72 formed therein for the purpose of overlying a wire or cable, or the like, as described above with regard to concave recess 76 in cover 40. However, recess 72 is of greater depth than recess 76.

Figure 2:
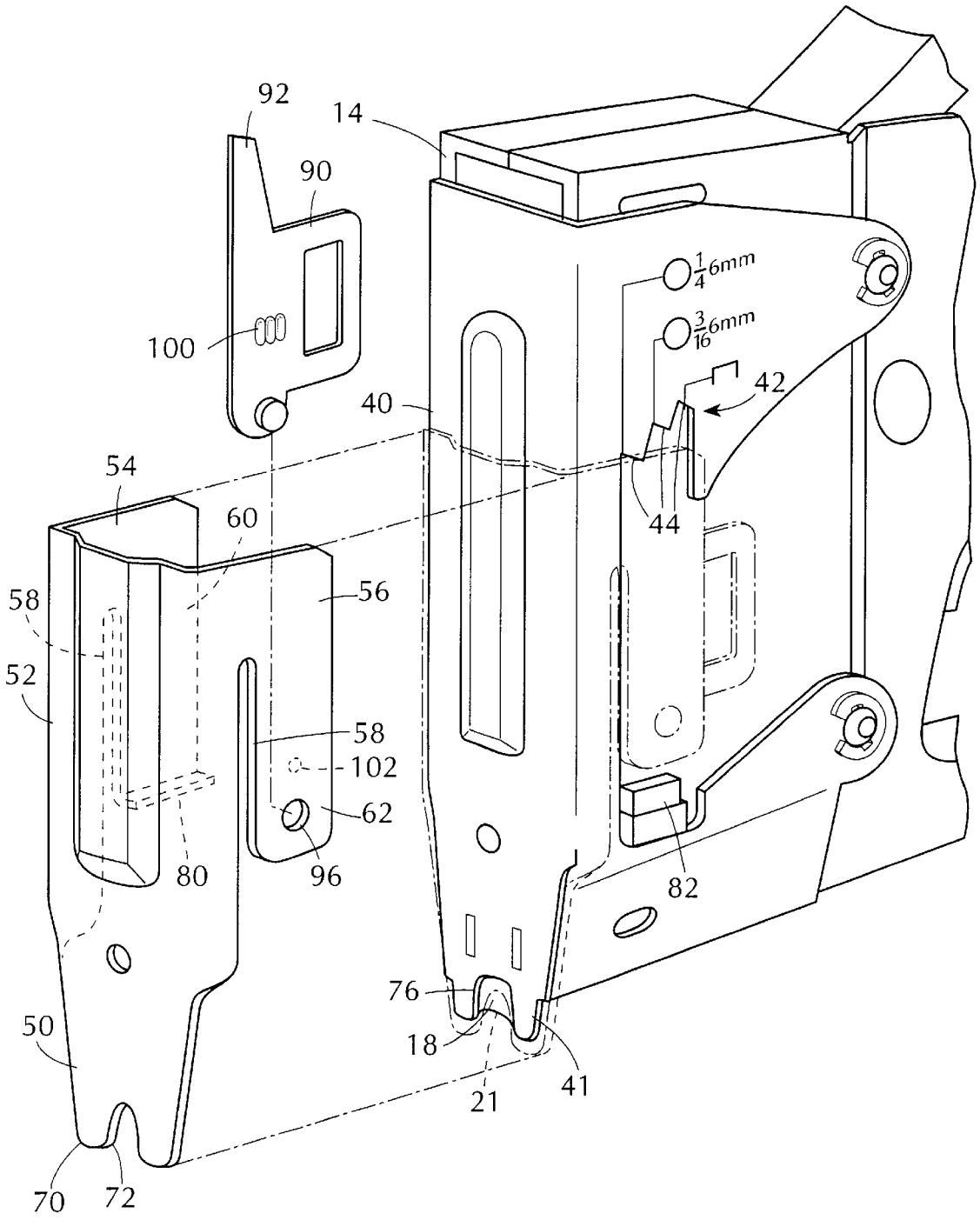
FIG. 2 is an exploded perspective view of the staple spacer guide and front end of the staple gun tacker shown in FIG. 1.

Spacer guide 50 is resiliently retained on the housing 12 by legs 60, 62. These legs, as seen in FIG. 2, are bent slightly inwardly. Since the cover is formed of a resilient metal material, these permanently bent legs apply a resilient gripping force to housing 12 which holds the guide removably on the housing while allowing it to slide vertically with respect to cover 40. This sliding movement adjusts the position of free end 70 of spacer guide 50 relative to the staple discharge opening 53 (FIG. 5) in base 22 of the staple gun. Leg 60 has an inwardly extending tab 80 which is located to engage the conventional bumper structure 82 that extends out of the staple gun tacker housing. This provides a lower stop for the position of the spacer guide relative to the housing.

Figure 5:
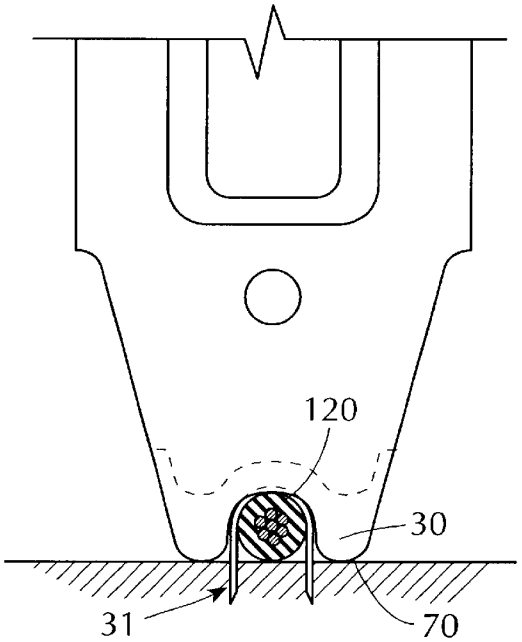
FIGS. 3, 4 and 5 are front end views of the staple gun tacker shown in FIG. 1 illustrating the three positions to which the spacer guide can be moved.
Figure 6:
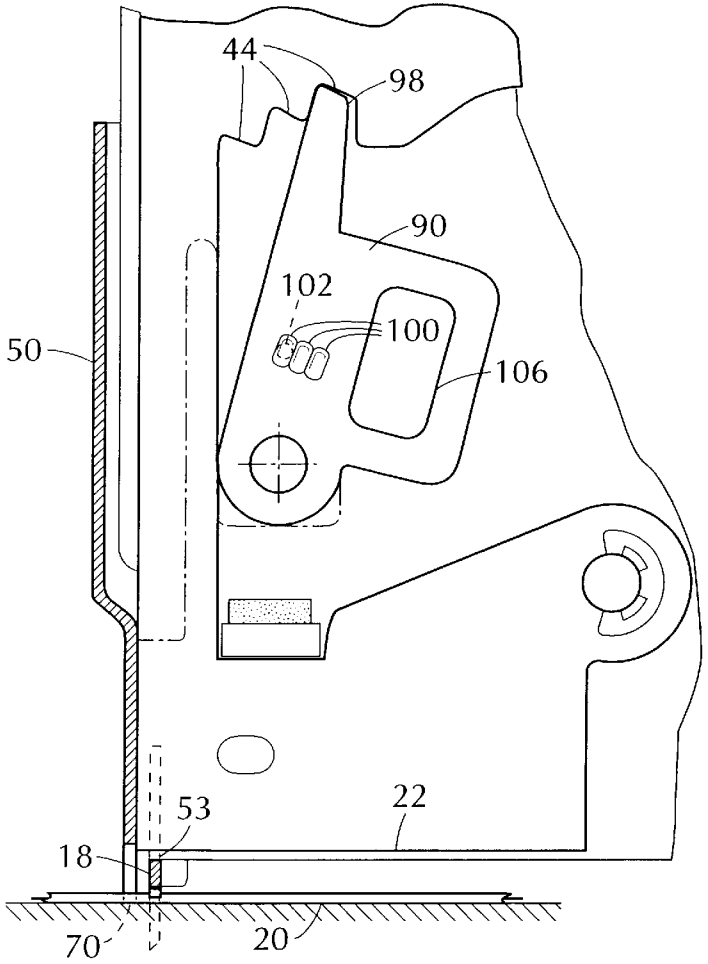

The upper limit of movement of the staple guide 50 is controlled by the stop surfaces 44 previously described. These stop surfaces are located to cooperate with a control plate 90, illustrated in FIGS. 5 and 6. Control plate 90 is a flat metal plate having a finger extension 92 formed thereon. Finger 92 is located to selectively engage stop surfaces 44. Plate 90 is pivotally mounted on a short pin 94 which is in turn mounted in a pivot opening 96 formed in the spacer guide leg 62. This allows plate 90 to pivot relative to leg 62 within a limited range of motion, the extremes of which are shown in FIGS. 5 and 6.

Figure 7:
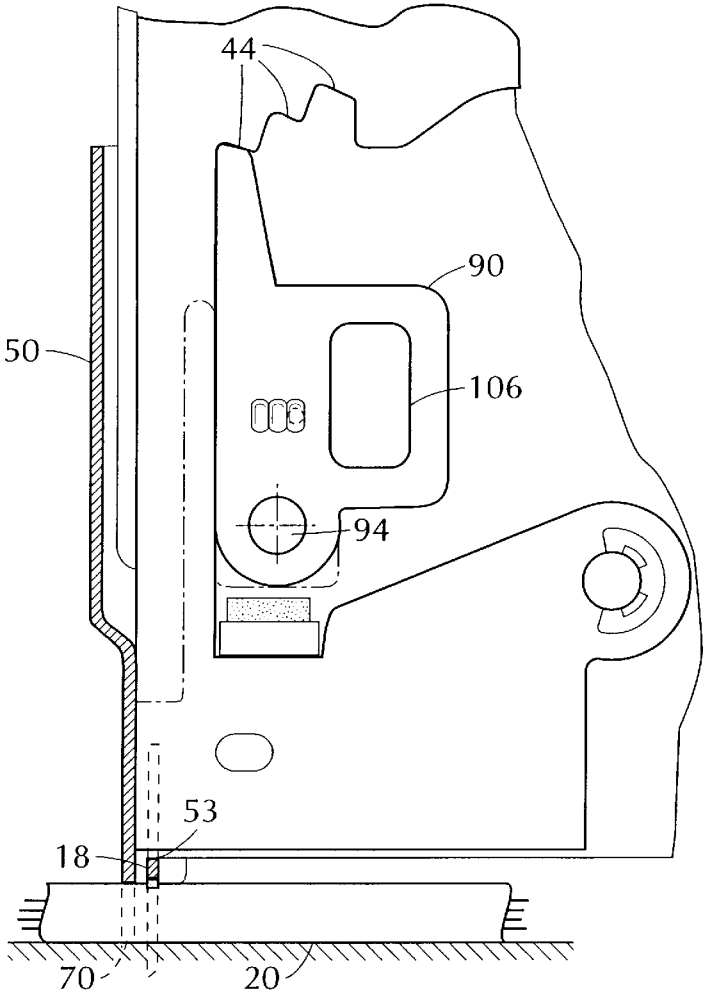
FIGS. 6 and 7 are side views, with the spacer guide partially broken away, illustrating the cooperating means on the spacer guide and the front end of the staple gun housing to control the position of the free end of the spacer guide relative to the discharge opening of the staple gun.

In the preferred embodiment illustrated in the drawings, plate 90 can pivot between three positions to selectively cause free end 98 of finger 92 to engage one of the three stop surfaces 44. Plate 90 has three recesses or grooves 100 formed on its outer surface which selectively engage with a small dimple or protuberance 102 formed or stamped on the inner surface of leg 62 to hold the plate in one of three positions, the two extremes of which are shown in FIGS. 6 and 7. By manually sliding spacer guide 50 to its lowermost position defined by the engagement of flange 80 with bumper 82, the operator can pivot plate 90, using the finger tab opening 106, between one of the three positions. When the desired position is selected, the plate is slid back upwardly to engage the surface 98 with the selected stop surface 44. This positioning of guide 50 defines the amount to which free end 70 of the spacer guide extends beyond discharge opening 53 of the staple gun tacker. As seen in FIG. 3, the spacer guide 50 is shown in its uppermost position, corresponding to the position of plate 90 in FIG. 6. In this position the discharge opening 53 is closest to the workpiece and the staple gun can be used to drive flat crowned staples. Thus, when knife 18 is driven downwardly to its extreme lowermost position in the housing, it will drive the staples to the greatest possible depth of penetration.

In the intermediate position of plate 90 wherein finger 92 is in the central stop surface 42 the nose is positioned further down relative to the nose 41 of cover 40, as seen in FIG. 4. This corresponds to the position marked "3/16 5 mm" on cover 40 in FIG. 1. This position is preferably used with a round crown staple and smaller diameter wires, as illustrated by the wire 120 in FIG. 4.

When it is desired to use the staple gun to secure a larger diameter wire, for example television cable wire, it is necessary that the crown of the staples be spaced further from the workpiece so as not to damage the wire. To accomplish this, spacer guide 50 is slid down again on the housing to engage stop flange 80 with bumper 82 thereby freeing plate 90 for pivotal movement from, for example, the position shown in FIG. 6 to the position shown in FIG. 7. The spacer guide is then slid back up on the housing to engage surface 98 with the forwardmost stop surface 44. When the nose of the staple gun is then engaged against the workpiece, free end 70 of the spacer guide engages the workpiece, as shown in FIG. 5, holding discharge opening 53 of the staple gun tacker still further away from the workpiece than it did in the position shown in FIG. 4. In this position, when knife 18 of the staple gun tacker is driven to its lowermost position upon operation of handle 16, the staple will not be driven as deeply into the wood. The crown of the staple remains spaced from the wood without damaging the larger diameter cable wire.

By the arrangement of the present invention, the workman using Applicant's staple gun tacker has the ability to quickly adjust the depth of penetration of the staples relative to the particular item being stapled to a workpiece, thereby to ensure that the element being stapled is not damaged. The staple gun tacker will accommodate various leg length staples, as is known in the art.

Although an illustrative embodiment of the present invention has been described herein with reference to the accompanying drawings, it is to be understood that various changes and modifications may be effected therein by those skilled in the art without departing from the scope or spirit of this invention.

I claim:

1. A staple gun tacker for driving staples of various leg lengths comprising, a housing having a staple driving end, including a staple discharge opening in the housing;

a staple spacer guide slidably mounted on the staple driving end of the housing adjacent the staple discharge opening and including a free end extending beyond said opening, and means for selectively controlling the position of said spacer guide on the housing and the position of its free end relative to said staple discharge opening thereby to selectively control the depth of penetration of staples driven by said staple gun into a workpiece;

said means for selectively controlling the position of said spacer guide including cooperating means on said spacer guide and housing for limiting the position to which the spacer guide can be retracted along the housing relative to said staple discharge opening;

said cooperating means comprising a plurality of stop surfaces formed on said housing at predetermined distances from said staple discharge opening and selectively adjustable means on said spacer guide for selectively engaging said stop surfaces:

said selectively adjustable means comprising a stop plate pivotally mounted on said spacer guide for movement therewith including an abutment surface for selectively engaging one of said stop surfaces in accordance with the position to which said plate is pivoted.

2. A staple gun tacker as defined in claim 1 including means for selectively holding said pivot plate in a selected pivoted position relative to said spacer guide to selectively engage a selected one of said stop surfaces.

3. A staple gun tacker as defined in claim 2 wherein said housing has a front cover and said stop surfaces are formed in said cover.

4. A staple gun tacker as defined in claim 3 wherein said spacer guide is slidably mounted on said housing to partially overly said front cover and said pivot plate is mounted thereon adjacent said stop surfaces of the front cover.

5. A staple gun tacker as defined in claim 4 including means on said guide for resiliently and removably retaining the guide on the housing.

6. A staple gun tacker for driving staples of various leg lengths comprising, a staple gun housing having a front staple driving end and a base, said base having a staple discharge opening formed therein through which staples to be driven by the staple gun are discharged into a workpiece;

a staple spacer guide slidably mounted on the staple driving end of said housing and including a free end which extends beyond said staple discharge opening and said base, and means for selectively controlling the position of said spacer guide on the housing and the extent to which said free end extends beyond said base, thereby to control the depth of penetration of staples driven by said staple gun into a workpiece;

said means for selectively controlling the position of said spacer guide on the housing including cooperating means on said spacer guide and on the housing for selectively limiting the position to which the spacer guide can be retracted along the housing relative to said base thereby to control the position of said staple discharge opening relative to the workpiece into which the staple is to be driven;

said cooperating means comprising a plurality of stop surfaces formed on said housing at predetermined distances from said staple discharge opening and selectively adjustable means on said spacer guide for selectively engaging said stop surfaces;

said selectively adjustable means comprising a stop plate pivotally mounted on said spacer guide for movement therewith including an abutment surface for selectively engaging one of said stop surfaces in accordance with the position to which said plate is pivoted.

7. A staple gun tacker as defined in claim 6 including means for selectively holding said pivot plate in a selected pivoted position relative to said spacer guide to selectively engage a selected one of said stop surfaces.

8. A staple gun tacker as defined in claim 7 wherein said housing has a front cover and said stop surfaces are formed in said cover.

9. A staple gun tacker as defined in claim 8 wherein said spacer guide is slidably mounted on said housing to partially overly said front cover and said pivot plate is mounted thereon adjacent said stop surfaces of the front cover.

10. A staple gun tacker as defined in claim 9 including means on said guide for resiliently and removably retaining the guide on the housing.

* * * * *